US005361515A

United States Patent [19]

Peremyschev

[11] Patent Number: 5,361,515

[45] Date of Patent: Nov. 8, 1994

[54] METHOD OF DRYING A PROTECTIVE POLYMER COATING APPLIED ONTO A SURFACE OF AN ARTICLE FROM A SOLUTION, AND DEVICE FOR EFFECTING THEREOF

[76] Inventor: Vladimir A. Peremyschev, Moscow, Russian Federation

[73] Assignee: Nauchno-Proizvodstvennaya Firma Aktsionernoe Obschestov Zaknytogo Tika Teknologia, Obarudovanie Materialy (AO "TOM"), Moscow, Russian Federation

[21] Appl. No.: 983,843

[22] PCT Filed: May 8, 1991

[86] PCT No.: PCT/SU91/00088

§ 371 Date: Mar. 2, 1993

§ 102(e) Date: Mar. 2, 1993

[87] PCT Pub. No.: WO92/19925

PCT Pub. Date: Nov. 12, 1992

[51] Int. Cl.[5] ..... F26B 7/00

[52] U.S. Cl. ..... 34/393; 34/413; 34/62

[58] Field of Search ..... 34/39, 40, 41, 1 W, 34/1 V, 13; 118/58, 69

[56] References Cited

U.S. PATENT DOCUMENTS 4,621,439 11/1986 Maw-Chyi ..... 34/92
4,908,231 3/1990 Nelson ..... 427/55

FOREIGN PATENT DOCUMENTS 0085650 8/1983 European Pat. Off. .
2158151 1/1974 Germany .
2433310 1/1976 Germany .
171801 7/1965 U.S.S.R. .
444040 10/1974 U.S.S.R. .
504056 3/1976 U.S.S.R. .
507755 4/1976 U.S.S.R. .

OTHER PUBLICATIONS

V. P. Lavreschev, et al. "The Investigation of the Mechanism for Removing . . . photoresist Film", Microlectronics Tech, Series 3, 1975, pp. 58–65.

V. V. Anufrienko, et al., Unit AII-2 for Shaping Fluoro-Resistive Coatings, Registration Date of Article, Jun. 1, 1978.

*Primary Examiner*—Henry A. Bennet
*Attorney, Agent, or Firm*—Ladas & Parry

[57] ABSTRACT

The method and apparatus operate to complete the following stages. At the first stage the coating is held at room temperature in the time interval from 20 s to 1 hour, depending on the type of polymer coating. At the second stage the coating is held at an elevated temperature under excessive pressure, sufficient for suppressing propagation of microcracks in such time interval so that at reaching the predetermined protective properties the thermodestruction of the polymer coating does not occur. At the third stage performed is the cooling of the coating to room temperature. According to the invention, the excessive pressure is built up at the first stage and maintained at the cooling stage. The invention may find application in manufacture of integrated circuits, as well as for the formation of thin polymer insulation coatings.

16 Claims, 2 Drawing Sheets

METHOD OF DRYING A PROTECTIVE POLYMER COATING APPLIED ONTO A SURFACE OF AN ARTICLE FROM A SOLUTION, AND DEVICE FOR EFFECTING THEREOF

TECHNICAL FIELD

The invention relates to a field of microelectronics, electrical engineering, and more particularly—to a method of production of a protective polymer coating applied onto a surface of an article from a solution, and a device for effecting thereof.

BACKGROUND ART

In the planar technology of semiconductor devices and microcircuits widely known is a method of drying a protective polymer coating applied onto a surface of an article from a solution, including a stage of holding the coating at temperatures of the process room, a stage of subsequent holding at an elevated temperature under an excessive pressure, and a stage of cooling. The method is intended to tackle the problems of producing high-quality defect-free polymer films and maintaining their protective properties during a certain period of time. The protective properties of coatings are greatly affected by microcracks, blisters, which are formed and propagated depending on physico-chemical processes, occurring during drying (as used herein drying is a process of escape of a solvent from the polymer coating).

Drying-out of the coating material (drying) includes the processes of transfer of the solvent in the polymer itself (liquid diffusion), in gaseous atmosphere (gas diffusion) and a transition of the solvent from the liquid state into vapor (a phase transformation of the first kind). Kinetic characteristics of the above-indicated processes determine the mechanism of escape of the solvent from the coating.

The initial stage of drying, which is carried out at temperatures of the process room (20°–24° C.), is characterized by a high content of the solvent in the polymer coating and high rates of its liquid diffusion. As the coating becomes dry, the solvent diffusion in the polymer material is retarded, which leads to lowering the drying rate.

It is known that by holding the polymer coating only at temperatures of the process room, it is impossible to obtain high values of protective properties (adhesion, defect-free condition).

Therefore, the temperature is held at the second stage at an elevated temperature. The temperature is selected for reasons of necessity to obtain a high flow of the polymer for increasing the rate of diffusion and relieving internal stresses of the coating, but with reference to thermostability of the polymer material, since a high temperature and its long action result in undesirable reactions of thermodestruction or thermopolymerization.

At the initial stage of holding of the polymer coating at an elevated temperature there registers a sharp increase of the rate of escape of the solvent. Having then reached its maximum value, this rate drops to zero.

It is thought that in parallel with evaporation of the solvent, on the external surface of the coating there occurs a phase transition (evaporation) also on the surface of gas microcracks, present in the coating (internal vapor formation).

Experiments confirm a connection between internal vapor formation and protective properties of, for example, a photoresistive coating. Kinetic characteristics of the process of evaporation of the solvent inside a microcrack are determined by a great number of factors: content of the solvent in the coating, pressure of the solvent vapor, initial forms and sizes of microcavities, density of distribution of microcracks in the coating volume, coefficient of liquid diffusion of the solvent, toughness and surface tension of the polymer coating, and by temperature of the coating.

The increase of the rate of internal vapor formation is accompanied by increase of unsoundness and decrease of adhesion of the coating to an article. The phenomena occur as a result of propagation of microcracks, saturated with vapors of the solvent, and subsequent opening of them on the coating external surface.

The location of closed microcracks relative to the coating external surface and the coating-to-article boundaries exert a great effect on the process of defects formation. Thus, microcracks located close to the external surface of the coating, when opening, do not affect deep layers of the polymer coating and do not exert such effect on the protective properties and adhesion, which is exerted by microcracks located on the article-to-polymer coating boundary. The latter, in addition to separation of the coating, When opening on the external surface, create through punctures. Microcracks located in the middle layers of the coating create prerequisites for the formation of punctures and, as areas of concentration of internal stresses of the coating, weaken its adhesion to the article..

Internal vapor generation in the protective coating with a high content of the solvent at the first stage of drying does not exert a noticeable effect, which decreases the protective properties of the polymer coating.

This is explained by the following reasons: favorable conditions for evaporation of the solvent, associated with a high coefficient of liquid diffusion in the coating and a state of a high flow of the polymer solution, which is greatly conducive to healing of developing microcracks.

Decreasing of the solvent content is accompanied by an increase of viscosity of the polymer coating and a loss of the planarization ability (as used herein the planarization ability is an ability of the polymer to create a flat surface and to heal irregularities of edges of the opened microcracks).

It is impossible to accurately determine the moment, when the solution flow will be insufficient for healing microcracks of dangerous forms and sizes, inasmuch as there are no relevant methodics. It is only possible with a certain truth, confirmed by practical data, to think that for the majority of photoresistive coatings this happens upon completion of centrifuging, at which excess of the polymer protective coating are removed.

Considering gas microcracks as a cause of originating punctures in the protective coating and as a cause of weakening the adhesion, it is necessary to point out to a polydispersive character of their sizes and forms. Naturally, with the diminishing of large microcracks, the protective properties of coatings are particularly improved.

At the same time, duration of storage of dried coatings may render dangerous even small microcracks.

Probably, for each process, depending on the conditions of its carrying out and requirements to protective properties, the maximum permissible size of microcracks may be determined at which deterioration of protective properties below the necessary values does not take place.

The nearest to the invention is a method of drying the protective polymer coating, applied onto an article from the solution, including a stage of holding the polymer coating within the range of temperatures of the process room in the time interval from 20 s to 1 hour, a stage of subsequent holding of the polymer coating at am elevated temperature under excessive pressure, sufficient for suppressing the process of propagation of microcracks in the coating, deteriorating its protective properties, and a stage of cooling of the polymer coating (V. P. Lavrischev, V. A. Peremyschev "Study of mechanism of removing the solvent from the photoresist film", 1975 Electronics, issue 5 (53), pages 58–65).

The factor preventing the action of internal vapor formation and suppressing the propagation of gas microcracks is an excessive external pressure, when holding the protective coating under conditions of an elevated temperature.

The polymer coating dried according to the above-indicated method has defects in the form of punctures and weak places. The method features loss of adhesion, which shortens the working life of the polymer coating. Both drawbacks are initiated by the process of propagation of microcracks of the coating during its drying.

Suppression of this process at the stage of holding the polymer coating at an elevated temperature does not always ensure fulfilment of technical requirements to protective properties of polymer coatings.

Known in the art is a device for effecting a method of drying the protective polymer coating applied onto an article from the solution, including a high-temperature air-tight chamber for holding the polymer coating at an elevated temperature, connected to a high-pressure main and an open outlet into the external volume through pipelines with valves, having a loading hatch with an air-tight damper, an unloading hatch with an air-tight damper, a mechanism for moving the article from the loading hatch to the unloading hatch, and a heater ("Electronic industry" No. 5 (77), 1979, Moscow, V. V. Anufrienko, V. I. Osnin, V. A. Peremyschev, V. L. Sanderov, V. N. Tsarev "Unit for forming photoresist coatings AFF-2", pages 50–52).

In such devices the excessive pressure is built up at the stage of holding the polymer coating at elevated temperatures. In this case, building-up of the excessive pressure in a high-temperature chamber is possible only after loading the article inside the chamber and closing the loading hatch with am air-tight damper, whereas releasing of this pressure is effected prior to the moment when the coating is cooled to the temperature at which, under conditions of the normal pressure, eliminated is the process of propagation of microcracks in the coating, deteriorating protective properties of the coating.

Even an inconsiderable delay of the excessive pressure action relative to heating of the coating has a noticeable negative effect owing to a small (fractures of a micrometer) thickness and heat capacity of the coating. After bringing the coating into the heated volume of the high-temperature chamber, it gets heated practically instantaneously to the temperature of the gas in the chamber. But it is impossible to build up excessive pressure instantaneously. In such heated state the coating is at the moment of releasing pressure prior to opening of the high-temperature chamber for unloading the article. But heating of the polymer coating without the excessive pressure brings about intensification of the internal vapor generation, which forms favorable conditions for propagation of microcracks in the protective coating.

SUMMARY OF THE INVENTION

The invention addresses the problem of providing a method of drying the protective polymer coating applied onto the surface of an article from solution, in which at the stage of holding the coating at the temperature of the process room there would be created such conditions of drying the coating, under which the action of excessive pressure would precede the temperature rise; at the stage of cooling it would be necessary to create such conditions under which the temperature drop would precede the cessation of action of excessive pressure, and also, to develop a device which would be cheap in manufacture, convenient and reliable.

The problem is solved by the method of drying the protective polymer coating, applied onto the surface of an article from the solution, including a stage of holding the polymer coating in the range of temperatures of the process room in the time interval from 20 s to 1 hour, a stage of subsequent holding of the polymer coating at an elevated temperature under an excessive pressure, sufficient for suppressing the process of propagation of microcracks in the coating, deteriorating its protective properties, and a stage of cooling of the polymer coating. According to the invention, the excessive pressure sufficient for suppressing the process of propagation of microcracks in the coating, thereby deteriorating its protective properties, is built up at the stage of holding of the polymer coating in the range of temperatures of the process room and maintained at the stage of cooling of the polymer coating until it reaches the temperature at which, under conditions of atmospheric pressure, the process of propagation of microcracks in the coating, which deteriorate the protective properties of the coating, is eliminated.

The problem is also solved by a device for effecting the method, including a high-temperature air-tight chamber for holding the polymer coating at an elevated temperature, connected to a high-pressure main and an open outlet into the external volume by means of a pipeline with valves, having a loading hatch with an air-tight damper, an unloading hatch with an air-tight damper, a mechanism for moving the article from the loading hatch to the unloading hatch and a heater. According to the invention, installed before the high-temperature chamber in the direction of movement of the article is an additional air-tight chamber for drying the polymer coating at the temperature of the process room, communicated with the high-temperature chamber by means of the loading hatch with an air-tight damper, having its own loading hatch with an air-tight damper, connected to the high-pressure main and an open outlet into the external volume by means of a pipeline with valves and provided with a mechanism for moving the article from the loading hatch of the additional air-tight chamber to the loading hatch of the high-temperature chamber, and after the high-temperature chamber in the direction of the movement of the article installed is an additional air-tight chamber for cooling the polymer coating, communicated with a high-temperature chamber by means of the unloading hatch with an air-tight damper, having its own hatch for unloading with an air-tight damper, connected to the high-pressure main and an open outlet into the external volume by means of the pipeline with valves and having a mechanism for moving the article from the hatch for unloading the article from the high-temperature chamber to the hatch for unloading the article from the cooling chamber.

To reduce the time for cooling, it is desirable to additionally provide the air-tight chamber for cooling the polymer coating with a cooler.

In the method of drying the polymer coating, applied onto the article subsurface from a solution, due to building up an excessive external pressure at the stage of holding the coating at temperatures of the process room, eliminated is a possibility of the temperature effect on the polymer coating up to the moment of reaching such an excessive pressure, at which is stopped the growth of gas microcracks, deteriorating the protective properties of the coating.

Moreover, building up an excessive pressure at the stage of cooling the polymer coating provides a possibility to prevent vigorous escape of residual solvent from the heated protective coating under the atmospheric pressure, resulting in the initiation of microcracks on the surface of the polymer coating, deteriorating its protective properties.

BRIEF DESCRIPTION OF DRAWINGS

The invention is explained further by the description of concrete examples of its embodiment and attached drawings, in which.

PREFERRED EMBODIMENT OF THE INVENTION

Figure 1:
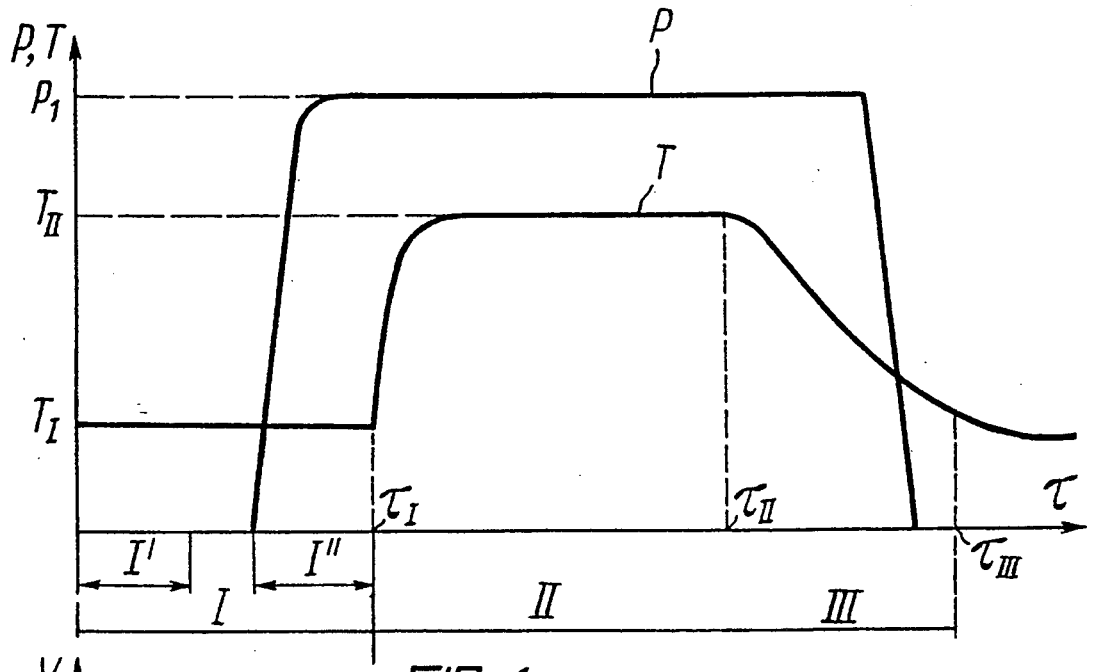
FIG. 1 shows a dependence of the temperature T and pressure P, laid off along the Y-axis, on the time $\tau$ of drying, laid off along the Y-axis according to the method of drying the protective polymer coating, applied onto the article surface from a solution.

The method of drying the polymer coating, applied onto the article surface from a solution, includes the following stages: stage I (FIG. 1) of holding the coating at the temperature of the process room within the interval from 20 s to 1 hour, during which in the zone of holding built up is an excessive external pressure that suppresses propagation of microcracks, deteriorating the protective properties of the coating; stage II of holding the coating at an elevated temperature under an excessive external pressure that suppresses propagation of microcracks, which deteriorate the protective properties of the coating during the time sufficient for obtaining the predetermined mechanical and protective properties, but not causing thermal structural changes of the coating; stage III of cooling the coating under the appropriate excessive external pressure to a temperature at which, under conditions of the atmospheric pressure, there is no propagation of microcracks, which deteriorate the protective properties of the coating.

Figure 2:
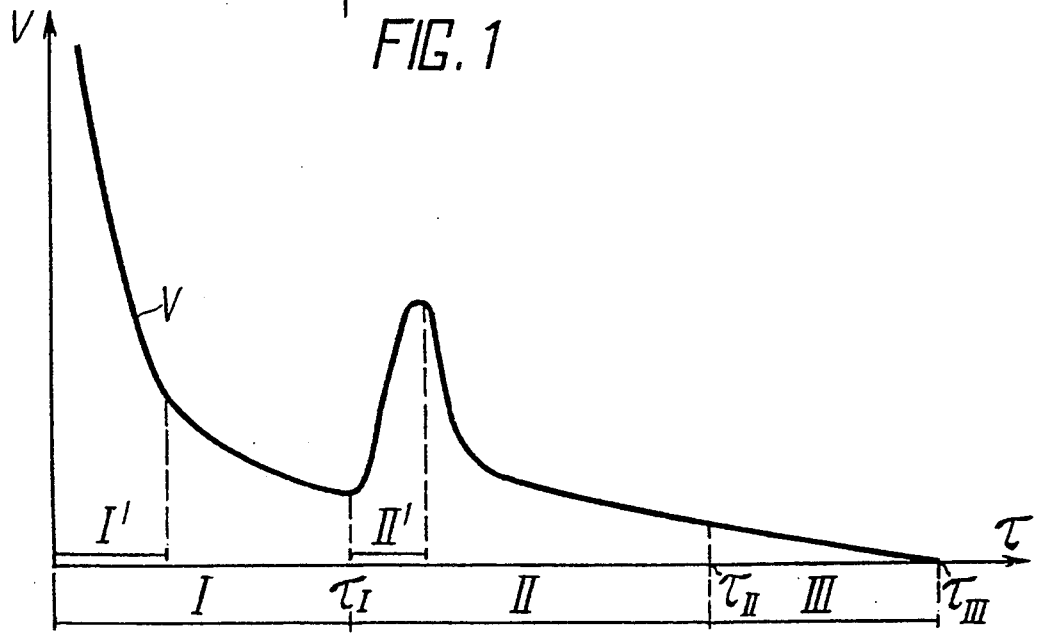
FIG. 2 shows a dependence of the rate V of escape of the solvent, laid off along the Y-axis, on the time $\tau$ of drying, laid off along the X-axis.

Stage I starts from the application of the polymer solution in the form of a coating onto the article surface, for example, by the method of centrifuging. Rotation of the article with the applied coating should be considered as an initial step I' (FIG. 1) of the stage I of holding the coating at a constant temperature $T_I$ of the process room. In this case, noted are the maximum rates of drying at the step I' (FIG. 2), at which there occurs a forced acceleration of diffusion of the solvent in the gas medium, owing to centrifuging.

The stage I is characterized by decreasing the content of solvent in the coating, which increases its viscosity and decreases the ability of the polymer material to heal over microcracks, appearing in the coating. The transition of the polymer coating to such a condition at the stage I specifies the necessity to prevent the increase of sizes of microcavities owing to the internal vapor generation by way of building up at this time (step I'' in FIG. 1) an excessive external pressure, which suppresses the internal vapor-generation and, consequently, propagation of microcracks, deteriorating the protective properties of the polymer coating.

The duration of step I' of holding the polymer coating at the temperature $T_I$ of the process rooms to the beginning of building up the excessive external pressure is determined by the time required for reaching an optimum condition of the coating. The optimum for each specific case should be considered such a condition of the coating at which it is less subjected to propagation of microcracks and, consequently, deterioration of protective properties in this case will be minimal. This condition is determined by a number of physico-chemical and mechanical characteristics of the coating. In the first place, by thickness of the coating, content of the solvent, pressure of its vapors, rate of diffusion of the solvent, viscosity of the coating material, surface tension, the nature of porosity of the coating, temperature and by the external pressure.

It is clear that each type of the polymer coating is characterized by its optimal condition and duration of holding at the temperature of the process room. The time $\tau_I$ is established experimentally and for the overwhelming majority of polymer coatings is within the interval from 20 s to 1 hour. If the time $\tau_I$ of holding the polymer coating at the stage I is less than 20 s, the residual content of the solvent will still be considerable, which will lead to its more intensive escape at the next stage II. Holding the polymer coating at the stage I in excess of 1 hour will lead to increasing the time of drying without the improvement of protective properties.

Building up the excessive external pressure of the proper value, which is determined by characteristics of the polymer and solvent, the temperature $T_{II}$ of the coating, requirements to its protective properties, mainly requires a range of 0.3–0.8 MPa. The excessive pressure of less than 0.3 MPa will be insufficient for decreasing propagation of microcracks. And increase of the excessive pressure in excess of 0.8 MPa will not improve the protective properties of the coating.

At the stage II (FIGS. 1,2) holding of the coating at the elevated temperature $T_{II}$ (FIG. 1) is performed under conditions of the excessive pressure $P_I$, which suppresses propagation of microcracks.

Elevation of the temperature to a value $T_{II}$ facilitates lowering of viscosity of the polymer coating, which leads to increasing the rate V (FIG. 2, section II') of solvent escape. The duration $\tau_{II}-\tau_I$ of holding the polymer coating at the temperature $T_{II}$ (FIG. 1) makes up from 30 s to 1 hour and depends on the thickness and type of the polymer coating, mass and heat capacity of the article on which this coating is applied, kinetics of the process of heat-and-mass transfer, on the temperature $T_{II}$ of the coating and thermostability of the polymer.

Holding of the polymer for less than 30 s at the stage II will be insufficient for removing the solvent from the coating, whereas holding of the polymer coating in excess of 1 hour at an elevated temperature will result in a destruction of the polymer coating structure, which will cause a sharp deterioration of its protective properties. Therefore, the elevated temperature $T_{II}$ and the time $\tau_{II}-\tau_I$ of the stage II are selected, depending on the type of the polymer coating.

For example, a temperature $T_{II}$ at the stage II from 80° to 100° C. is considered acceptable for diazoquinone photoresist coatings. The use of the temperature $T_{II}$ below 80° C. at the stage II will not ensure complete removal of the solvent, which will lower the adhesion of the coating to the article surface.

Holding of the polymer coating at the temperature $T_{II}$ in excess of 100° C. is accompanied by accelerated thermodestruction of the polymer, which comprises the stability of the quality of protective properties.

Approximately the same dependencies determine the temperature-time conditions of the stage II of drying the electroresistive polymer coatings on the basis of polymethylmethacrylate. For such coatings the duration $\tau_{II}-\tau_I$ of holding lies within a period from 60 s to 1 hour in the temperature range $T_{II}$ of 160°–200° C.

Subsequently, cooling of the polymer coating to a temperature $T_{III}$ (FIG. 1, stage III), which is equal to $T_I$, is performed. The rate V (FIG. 2, stage III) of escape of the solvent at this stage III gradually drops to zero.

The device for effecting the method of drying the protective polymer coating applied onto the surface of the article from a solution, comprises an air-tight chamber 1 for holding the article (not shown in the drawing) with the polymer coating applied thereon at the temperature of the process room, located first in the direction of movement of the article. The chamber 1 has a loading hatch 2 with an air-tight damper 3 and an unloading hatch 4 with an air-tight damper 5. Located inside the chamber 1 is a platform 6 for receiving an article and a mechanism 7 for conveying the article from the loading hatch 2 to the unloading hatch 4. The conveying mechanism 7 is shown in the present version in the form of a conveyer belt.

The chamber 1 is connected with a high-pressure main 8 via a union 9 mounted into a wall of the chamber 1 body of an additional pipeline provided with valves 10,11 for pressure regulating. Besides, the same pipeline carries a valve 12 for communicating the chambers with the atmosphere.

After the air-tight chamber 1, in the direction of movement of the article, located is a high-temperature air-tight chamber 13 for holding the polymer coating at an elevated temperature.

The unloading hatch 4 of the chamber 1 in the present version serves as a loading hatch 14 of the high-temperature chamber 13. The air-tight chamber 1 communicates with the high-temperature chamber 13 through this unloading hatch 4.

The high-temperature chamber 13 is provided with a hatch 15 and an air-tight damper 16 for unloading the article. Inside the high-temperature chamber 13 installed is a platform 17 to receive the article, and a mechanism 18 for conveying the article from the loading hatch 14 to the unloading hatch 15 which is shown in the present version as a conveyer belt. The air-tight chamber 13 is connected with a high-pressure main 8 through a pipeline 19 provided with a union 20, and valves 21,22,23 for pressure regulating. Inside the high-temperature chamber 13 is a heater 24. After the high-temperature chamber 13, in the direction of movement of the article, is an additional air-tight chamber 25 for cooling the polymer coating.

The additional air-tight chamber 25 is provided with a loading hatch 26 and an air-tight damper 27, which simultaneously serves as the unloading hatch 15 of the high-temperature chamber 13. The hatch 26 serves to communicate the high-temperature chamber 13 with the additional air-tight chamber 25. In addition, the additional chamber 25 is provided with a hatch 28 for unloading the article with an air-tight damper 29. Inside the chamber 25 installed is a platfrom 30 to receive the articles and a mechanism 31 for moving the article from the loading hatch 26 to the unloading hatch 28.

Figure 3:
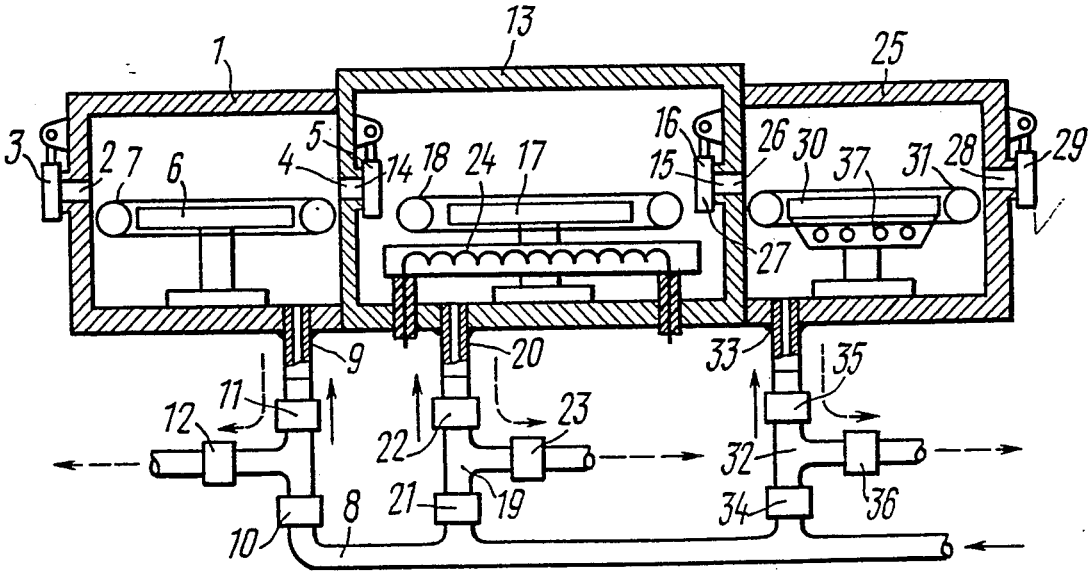
FIG. 3 shows a device for drying the polymer protective coating, applied onto the article surface from a solution, according to the invention, longitudinal section.

The chamber 25 is connected with the high-pressure main 8 through a branch pipe 32 provided with a union 33 and valves 34,35,36 for pressure regulating. Secured on the platform 30 is a cooler 37. Solid arrows in FIG. 3 show the direction of gas flow along the pipeline, when building up an excessive pressure in the chambers 1,13,25; broken arrows show the direction of gas flow, when the excessive pressure is reduced due to gas release into the atmosphere.

The distance between the mechanism 7 for moving the article in the chamber 1 and the mechanism 18 for moving the article in the high-pressure chamber 13 is selected not less than the length of the article for a free movement of the article from the chamber 1 to the chamber 13 with the air-tight damper 5 of the hatch 4 opened. The same relates to the distance between the movement mechanism 18 of the high-temperature chamber 13 and the mechanism 31 of movement of the additional air-tight chamber 25.

The device for effecting the method of drying the polymer coating, applied onto the article surface from the solution, according to the invention, operates as follows.

Preliminarily, the high-temperature chamber 13 is prepared for operation. For this purpose closed are the air-tight dampers 5 and 16, the heater 24 is engaged, the valves 21,22 of the high-pressure maim 8 are opened (the valve 23, which connects the chamber 13 with the atmosphere, is closed for the whole cycle of drying the polymer protective coating).

The article, with the polymer coating solution applied onto its surface, is placed through the opened loading hatch 2 by means of the movement mechanism on the platform 6 installed in the air-tight chamber 1. The damper 3 of the hatch 2 is closed, and valves 10,11 are opened (the valve 12, communicating the chamber 1 with the atmosphere, is closed) in order to build up excessive pressure in the chamber 1. Then the damper 5 of the unloading hatch 4 is opened and, using the movement mechanisms 7,18, the article is moved into the chamber 13 onto the platform 17. The elevated pressure in the chamber 1 and in the high-temperature chamber 13 is the same in this case.

During holding of the article in the high-temperature chamber 13, the cooling chamber 25 is prepared. For this purpose the air-tight damper 29 of the unloading hatch 28 is closed, the valve 36 communicating the chamber 25 with the atmosphere is also closed, and the valves 34,35 of the high-pressure main 8 are opened; then the cooler 37 is cut in.

During holding of the article, with the protective polymer coating applied onto it, in the high-temperature chamber 13, after releasing the excessive pressure in the chamber 1 by way of opening the valves 11 and 12 and closing the valve 10, the operator may open the damper 3 of the loading hatch 2 in order to receive the next article.

Upon expiration of the definite time of holding the coating in the high-temperature chamber 13, the damper 16 of the unloading hatch is opened, the mechanisms 18 and 31 of moving the article into the chamber 25 onto the platform 30 are engaged, and the damper 27 is closed. On completing the cooling of the polymer coating to the predetermined temperature, the valve 36 for releasing the excessive pressure is opened, the damper 29 of the unloading hatch 28 is also opened, the mechanism 31 of moving the article is engaged, and the article is unloaded from the chamber 26.

To reduce the time of cooling, the additional air-tight chamber 25 is provided with a cooler 37, by means of which the process of cooling the coating in the chamber 25 is initiated.

The device for effecting the method, according to the invention, makes it possible to perform drying of the polymer protective coating, with articles in a continuous flow. Due to the fact that the relation of time for the low-temperature thermal holding and cooling for various types of protective coatings is different, the device in the chambers 1,13,25 may have several platforms 6,17,30 (not shown in the drawing) for receiving the articles, and the movement mechanisms 7,18,31 may perform replacement of articles between additional platforms inside the chambers 1,13,25. Such a technical solution allows the device to operate in the continuous mode with a constant cycle.

To ensure a more precise understanding of the gist of the present invention, given below is a concrete example of its realization.

EXAMPLE

A comparative evaluation has been performed of protective properties of polymer coatings, dried by the method according to the invention, and coatings after drying them according to the known method.

For drying of photoresist polymer coatings, there have been used the known device and the device according to the present invention.

Loaded into the chamber 1 (FIG. 3) of the device, according to the invention, was an article—a chromium plated glass plate with a protective polymer coating—positive diazoquinone photoresist 0.7 μm thick, applied onto the plate from a solution. After drying photoresist coating, such articles are used as blanks for making masks. Within the volume of the chamber 1, after closing it and making it air-tight, by way of feeding gas from the high-pressure main 8, an excessive pressure of 0.5 MPa was built up, which later on invariably accompanied holding of the coating in the chamber 13 and chamber 25. The time of holding of the protective coating in the chamber 1 was 3 minutes, the temperature in the chamber 1 being 22°±2° C. The time of holding in the chamber 13 equalled 15 minutes, the temperature being 100° C. The time of cooling at the stage III in the chamber 25 was 3 minutes, the cooling final temperature being 22°±2° C.

Testing protective coatings for defects, dried according to the claimed method and according to the known one, was performed according to the generally accepted methods. The testing results are given below in the table.

TABLE

| Description of protective parameter 1 | Protective parameters standard 2 | Protective parameter indices, depending on testing time and method of drying on the day of drying: method according to the invention 3 | known method 4 |
|---|---|---|---|
| Total density of defects with size more than 1 μm, $cm^{-2}$ | not more than 0.20 | 0.03 | 0.09 |
| including punctures, $cm^{-2}$ | | 0.017 | 0.069 |
| chromium residues, $cm^{-2}$ | | 0.013 | 0.021 |
| Number of articles which fail to meet protective parameters standards, pcs | | 0 | 0 |
| Mask layer etching under protective coating, μm | not more than 0.2 | 0.1 | 0.15 |
| Number of articles, which fail to meet standards on mask layer etching, pcs | | 0 | 0 |
| Local mask layer etchig under polymer coating with size more than 0.5 μm, $cm^{-1}$ | not allowed | 0 | 0 |
| Number of articles which fail to meet standards for local etching, pcs | 0 | 0 | 0 |

| Description of protective parameter 1 | Protective parameter indices, depending on testing time and method of drying: after 2 months, method according to the invention 5 | after 2 months, known method 6 | after 4 months, method according to the invention 7 | after 4 months, known method 8 |
|---|---|---|---|---|
| Total density of defects with size more than 1 μm, $cm^{-2}$ | 0.028 | 0.16 | 0.04 | 0.29 |
| including punctures, $cm^{-2}$ | 0.015 | 0.14 | 0.02 | 0.27 |
| chromium residues, $cm^{-2}$ | 0.013 | 0.02 | 0.02 | 0.02 |
| Number of articles which fail to meet protective parameters standards, pcs | 0 | 1 | 0 | 9 |
| Mask layer etching under protective coating, μm | 0.1 | 0.2 | 0.12 | 0.35 |
| Number of articles, which fail to meet standards on mask layer etching, pcs | 0 | 3 | 0 | 10 |
| Local mask layer | 0 | 0 | 0 | 0.01 |

TABLE-continued

| | | | | |
|---|---|---|---|---|
| etching under polymer coating with size more than 0.5 $\mu m$, $cm^{-1}$ | | | | |
| Number of articles which fail to meet standards for local etching, pcs | 0 | 0 | 0 | 7 |

The indices of protective parameters were determined according to their arithmetical mean for 10 articles under testing. One can judge about the extension of the coating working life by comparison of indices of the tests of protective coatings dried according to the known method, and the method claimed by the invention, after 2 and 4 months with the widely known standards of protective parameters, as well as by the number of articles, which fail to meet these standards.

INDUSTRIAL APPLICABILITY

The invention relates to the manufacture of integrated circuits and concerns the processes and equipment in microlithography.

Moreover, the invention may be used for the production of thin protective polymer coatings, for example, varnish insulations on wires.

I claim:

1. A method for removal of a solvent from a protective polymer coating, wherein the polymer coating has been applied onto a surface of an article from a solution containing said solvent at an initial temperature within a temperature range of 18° to 28° C., wherein said coating has protective properties which are improved by drying the coating at an elevated temperature, wherein said coating is susceptible to the development of microcracks when subjected to drying at the elevated temperature and wherein the development of microcracks in the coating can be suppressed by subjecting the coating to an excessive pressure sufficient for suppressing the development of the microcracks during drying at said elevated temperature, said method comprising:

a) maintaining the polymer coating at said initial temperature for an initial drying period of about 20 seconds to about 1 hour after the polymer coating has been applied to the surface, and subjecting said coating to a build-up of pressure to said excessive pressure during the initial drying period;

b) heating the coating to said elevated temperature while maintaining the coating at said excessive pressure, said elevated temperature and excessive pressure being maintained for a second drying period sufficient to improve the protective properties of the coating; and c) cooling the polymer coating to a final temperature which is lower than said elevated temperature for a third drying period sufficient for substantially complete removal of the solvent, said excessive pressure being maintained during said third drying period until the coating drops to a temperature at which it is no longer susceptible to the development of microcracks.

2. A method as claimed in claim 1 wherein the initial drying period has a first stage and a second stage, and wherein the solvent is removed from the coating at a first rate of removal at the first stage of said initial drying period and at a slower rate of removal at the later stage of the initial drying period, the coating being subjected to said build-up of pressure during said later stage of the initial drying period.

3. A method as claimed in claim 2 wherein said initial temperature and said final temperature are the same.

4. A method as claimed in claim 2 wherein the third drying period has an initial stage and a latter stage, and wherein the coating is subjected to atmospheric pressure during said first stage of said initial drying period and during the latter stage of said third drying period, said latter stage commencing after the coating drops to a temperature at which it is no longer susceptible to the development of microcracks.

5. A method as claimed in claim 4 wherein the excessive pressure to which the coating is subjected is between about 0.3–0.8 Mpa.

6. A method as claimed in claim 5 where the second drying period lasts between about 30 seconds to 1 hour.

7. A method as claimed in claim 6 wherein the elevated temperature falls within a range of about 80° to 100° C.

8. A method as claimed in claim 5 wherein the elevated temperature is within a range of about 160°–200° C. and the second drying period lasts between about 60 seconds to 1 hour.

9. A method as claimed in claim 2 wherein the article with said coating is placed in a first chamber during said initial period of drying, said method comprising transferring said coated article to a second chamber for said second period of drying and to a third chamber for said third period of drying.

10. An apparatus for drying a protective polymer coating on an article under conditions including a first temperature between 18°–28° C., an elevated temperature which is higher than the first temperature and an elevated pressure which is higher than atmospheric pressure, said apparatus comprising:

a) first, second and third air-tight chambers capable of being pressurized to said elevated pressure;

b) pressurizing means connected to each of said first, second, and third chambers for independently pressurizing each of said chambers whereby to subject an article in each of said first, second, or third chambers to the elevated pressure; said pressurizing means comprising regulatory means for independently regulating the pressure to which each chamber is subjected whereby an article in at least the first and third chambers can be subjected alternatively to said elevated pressure and to atmospheric pressure;

c) heating means for maintaining the second chamber at said elevated temperature;

d) first means for conveying the article from said first chamber to said second chamber with said article and said first and second chambers maintained at said elevated pressure; and e) second means for conveying the article from said second chamber to said third chamber with the article and said second and third chambers maintained at said elevated pressure.

11. An apparatus as claimed in claim 10 wherein said pressurizing means can independently pressurize said first, second and third chambers to a pressure between at least 0.3–0.8 Mpa.

12. An apparatus as claimed in claim 11 wherein the apparatus further comprises cooling means for cooling the third chamber whereby to cool an article in the third chamber from said elevated temperature to said first temperature.

13. An apparatus as claimed in claim 12 wherein the apparatus further comprises means for maintaining the first chamber at a temperature in a range of about 18° to 28° C.

14. An apparatus as claimed in claim 13 wherein the first means comprises a loading hatch with a first air-tight damper connecting said first and second chambers and a first conveyor for moving the article from the first chamber to the first loading hatch, and wherein the second means comprises a first unloading hatch with a second air-tight damper connecting said second and third chambers, and a second conveyor for moving the article from the first loading hatch to the first unloading hatch.

15. An apparatus as claimed in claim 14 wherein the first chamber comprises a second loading hatch with a third air-tight damper for loading the article into the first chamber, with the first conveyor conveying said article from the second loading hatch to the first loading hatch, and wherein the third chamber comprises a second unloading hatch with an air-tight damper and a third conveyor for conveying the article from the first unloading hatch to the second unloading hatch.

16. An apparatus as claimed in claim 15 wherein the pressurizing means comprises a high-pressure main and a pipeline connected to each of said first, second and third chambers, and to ambient atmosphere, said regulatory means comprising valves for regulating the pressure in said first, second and third chambers.

* * * * *